United States Patent [19]

Wakefield et al.

[11] 4,316,497

[45] Feb. 23, 1982

[54] METHOD AN APPARATUS FOR FEED ON TO A TAKE-UP REEL IN HIGH SPEED SILICO

[75] Inventors: G. Felix Wakefield, Woodland Hills; David L. Bender, Thousand Oaks, both of Calif.

[73] Assignee: Atlantic Richfield Company, Los Angeles, Calif.

[21] Appl. No.: 148,319

[22] Filed: May 9, 1980

[51] Int. Cl.[3] ..... B22D 11/06

[52] U.S. Cl. ..... 164/479; 164/483; 164/452

[58] Field of Search ..... 164/87, 46, 423, 427, 164/429; 72/148; 242/67.3 R, 195; 156/242, 246, 501; 264/165, 169, 224, 212–216; 226/90, 91

[56] References Cited

U.S. PATENT DOCUMENTS

| | | | |
|---|---|---|---|
| 836,863 | 11/1907 | Clausen | 242/67.3 R |
| 3,094,833 | 6/1963 | Breffle | 242/67.3 R |
| 3,226,911 | 1/1966 | Vreeland et al. | 242/67.3 R |
| 3,608,615 | 9/1971 | Conlon | 164/87 |

*Primary Examiner*—Robert D. Baldwin
*Assistant Examiner*—K. Y. Lin
*Attorney, Agent, or Firm*—Nilsson, Robbins, Dalgarn, Berliner, Carson & Wurst

[57] ABSTRACT

A take-up reel and take-up reel starting feed for use in high speed ribbon crystallization of molten material e.g., a metal or a semiconductor material, in which a starting strip is pre-wound onto the take-up reel sufficiently to frictionally engage the take-up reel and be thereby drawn onto the take-up reel from a supply reel for the starting strip, and wherein the linear velocity of the starting strip in a contact zone is synchronized with the linear velocity of a cast ribbon of the material leaving a rotating drum on which the casting initiated, so that the ribbon of cast material, after it passes over the starting strip in the contact zone, will contact the starting strip and pass onto the take-up reel in contact with the starting strip and without bunching or significant stretching of the ribbon of cast material. After a sufficient number of revolutions of the take-up reel to ensure that the ribbon of cast material is frictionally engaged by the wrapping of a sufficient amount of the ribbon and starting strip, in contact with each other, about the take-up reel, the starting strip may be severed, leaving only the ribbon of cast material in the remaining wraps on the take-up reel.

11 Claims, 1 Drawing Figure

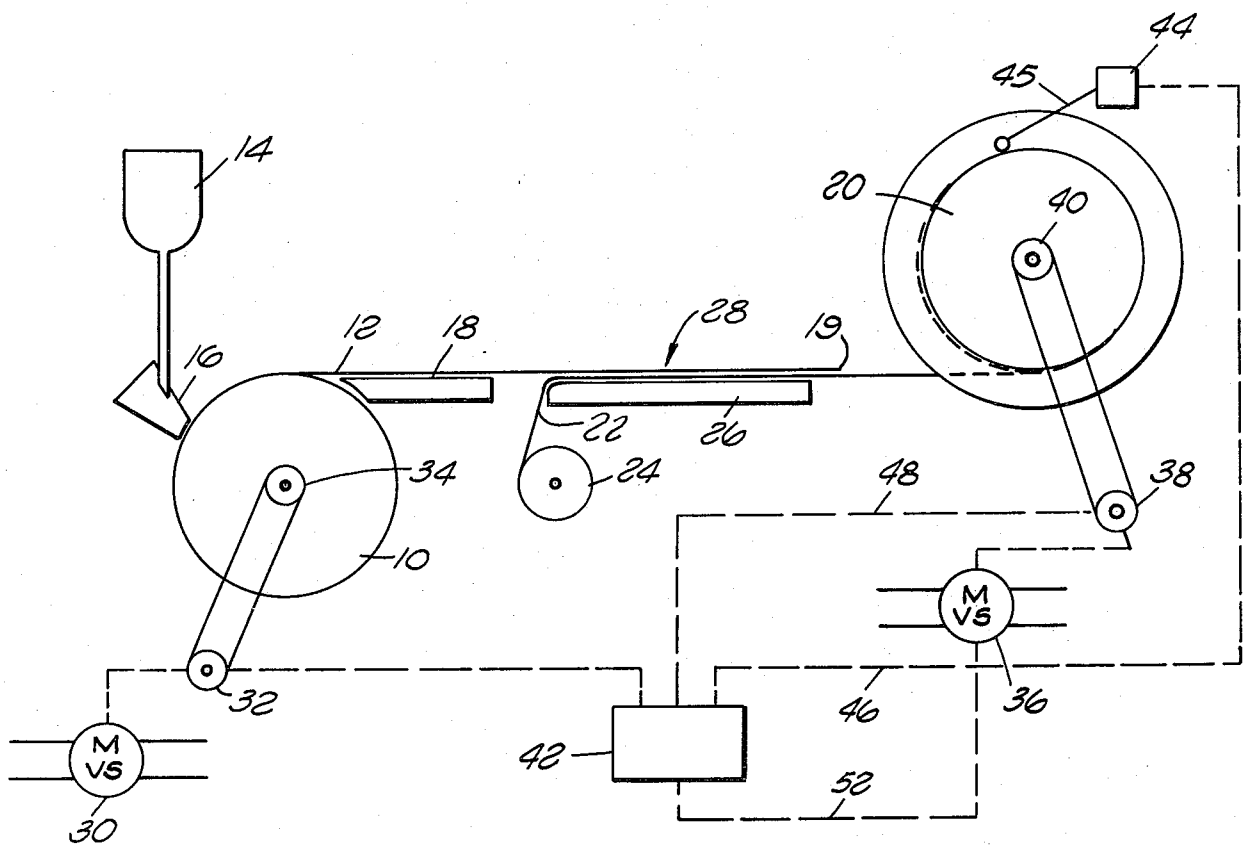
44
45
40
38
20
36
M
VS
48
46
50
19
28
26
22
24
42
18
12
34
10
14
16
32
30

METHOD AN APPARATUS FOR FEED ON TO A TAKE-UP REEL IN HIGH SPEED SILICO

CROSS REFERENCE TO RELATED APPLICATIONS

Application Ser. No. 147,804 in which the present inventors are co-inventors and Application Ser. No. 147,765 in which one of the present inventors is the inventor.

BACKGROUND OF THE INVENTION

This invention relates to a novel method and apparatus for feeding a thin ribbon of cast material, e.g., semiconductor material like silicon, among others, onto a take-up reel in an apparatus for casting a crystalline or coarse grain polycrystalline ribbon of the material. More particularly, this invention concerns a take-up reel and a take-up reel starting feed for use in high speed ribbon crystallization of molten material, in which a starting strip is prewound onto the take-up reel sufficiently to frictionally engage the take-up reel and be thereby drawn onto the take-up reel from a supply reel for the starting strip, and wherein the linear velocity of the starting strip across a contact zone is synchronized with the linear velocity of the ribbon of cast, i.e., crystallized, molten material, which leaves a rotating drum on which the casting is initiated, so that the ribbon of cast material, as it passes over the starting strip in the contact zone, will contact the starting strip and pass onto the take-up reel in contact with the starting strip, and without bunching or significant stretching of the cast ribbon.

In the manufacture of a thin elongated ribbon of cast material by continuous casting of a molten material, e.g., a metal or a semiconductor material, as is more fully explained in the co-pending application of the Applicants filed as Ser. No. 147,804, the disclosure of which is hereby incorporated by reference, a molten ribbon of material to be cast is extruded onto a rotating drum, the surface of which is cool, thereby initiating crystallization of the material. The ribbon of cast material which is thereby formed is a crystalline or coarse grain polycrystalline structure. Such a ribbon casting process can be carried out at very high speeds on the order of hundreds of feet per minute. In the case of semiconductor materials, the ribbons are extremely useful in many applications, including the production of photovoltaic solar cells.

However, the crystalline structure of the ribbon makes the ribbon relatively brittle and subject to damage from bending or stretching. In a high speed ribbon crystallization process, it is very desirable to have a means for taking up the ribbon produced by the crystallization process for storage in a continuous fashion without damaging the ribbon. Using a conventional take-up reel with a mechanism for grabbing the leading edge of the ribbon as the leading edge comes in contact with the take-up reel will cause damage to the ribbon by either crimping the ribbon or excessively stretching the ribbon, either of which may cause the ribbon to crack and break, thereby necessitating a further attempt at feeding the ribbon onto the take-up reel. This is so also because of the usually desirably thin dimension of the cast ribbon. Thus even with cast ribbons, of, e.g., metal, which may have a less brittle crystalline structure than, e.g., semiconductor materials, damage to the ribbon can occur with conventional take-up reel feeds. It is also desirable that the rotating drum be continuously in operation so that crystallization will not build up in the vicinity of the orifice described in the above-referenced co-pending patent application, clogging the orifice. Therefore, in order to avoid waste of the ribbon produced by the crystallization process during the changing of take-up reels from a first reel which is filled with the ribbon of cast material to a fresh reel for taking up additional ribbon, it is desirable to be able to quickly change reels and again wind the leading edge of the ribbon onto the new reel with as little time delay as possible.

The problems enumerated above regarding a high speed formation of a ribbon of crystalline or coarse grain polycrystalline material, are not intended to be exhaustive, but rather are among many which tend to impair the effectiveness of previously known methods and apparatus for taking up the ribbon of cast material formed in a high speed crystallization casting process. Other noteworthy problems may also exist; however, those presented above should be sufficient to demonstrate that methods and apparatus appearing in the prior art have not been altogether satisfactory.

SUMMARY OF A PREFERRED EMBODIMENT OF THE INVENTION

Recognizing the need for an improved method and apparatus for taking up the ribbon produced by a high speed casting of a ribbon of cast material and for feeding the leading edge of the ribbon on to the take-up apparatus, it is a general feature of the present invention to provide a novel take-up method and apparatus which minimizes or reduces the problems of the type previously noted.

It is a more particular feature of the present invention to provide a take-up reel and a take-up reel starting feed for use in high speed ribbon crystallization of material, e.g., metal or semiconductor material, in which a starting strip is pre-wound onto the take-up reel sufficiently to frictionally engage the take-up reel and be thereby drawn onto the take-up reel from a supply reel for the starting strip, and wherein the linear velocity of the starting strip across a contact zone is synchronized with the linear velocity of a cast ribbon leaving the rotating drum on which the casting initiated, so that the ribbon of cast material, as it passes over the starting strip in the contact zone, will pass on to the take-up reel in contact with the starting strip, and without bunching or significant stretching of the ribbon.

An example of the more important features of the present invention have thus been summarized rather broadly in order that the detailed description thereof that follows may be better understood, and in order that the contribution to the art may be better appreciated. There are, of course, additional features of the invention which will be described hereafter and which will also form the subject of the appended claims. These other features and advantages of the present invention will become more apparent with reference to the following detailed description of a preferred embodiment thereof in connection with the accompanying drawings, in which:

BRIEF DESCRIPTION OF THE DRAWING

The FIGURE shows a schematic view of the apparatus and method according to the present invention.

DETAILED DESCRIPTION OF A PREFERRED EMBODIMENT

Turning now to the FIGURE, there is shown a schematic view of the apparatus and method according to the present invention. As is more fully explained in the above-referenced co-pending application, a rotating drum 10 having a cooled surface is used for crystallizing a cast ribbon 12 of material, e.g., a metal or a semiconductor material which is supplied to the surface of the rotating drum 10 in a molten ribbon from a source 14 of molten material through a tundish 16.

The ribbon 12 is separated from the surface of the rotating drum 10 by, e.g., passing the ribbon 12 over a support surface 18. The leading edge 19 of the ribbon 12 is forced, by the continuing casting of the ribbon 12, towards a take-up reel 20. The feeding of the leading edge 19 of the ribbon 12 onto the take-up reel 20 is accomplished by the use of a starting strip 22 which is pre-wound on the take-up reel 20 sufficiently to be frictionally engaged and to draw the starting strip 22 from a supply roll 24 over a contact plate 26, and onto the take-up reel 20 due to the rotation of the take-up reel 20. The ribbon 12 is also passed over the contact plate 26, and above the starting strip 22 with the direction of travel of the leading edge 19 and the starting strip 22 being aligned and having approximately the same speed in a contact zone 28, where one surface of the ribbon 12 comes in contact with the starting strip 22. The ribbon 12 is thereby guided onto the take-up reel 20 by the starting strip 22 and passes onto the take-up reel 20 along with the starting strip 22 without crimping or excessively stretching the ribbon 12.

A suitable means, among many, for synchronizing the linear velocity of the ribbon 12 and the starting strip 22 in the contact zone 28 is also shown schematically in the FIGURE. The rotating drum 10 is driven by a variable speed motor 30 which is mechanically linked to a drive gear 32 which drives a drive wheel 34 connected to the rotating drum 10. The speed of rotation of the rotating drum 10 depends upon the parameters for the ribbon casting process and the desired properties of the ribbon produced by this process, as is well known in the art. Thus the necessary rotational speed of the rotating drum 10, as is set by the operator by changing the speed of the motor 30, will vary with, e.g., the type of the material, the desired rate of crystallization on the surface of the rotating drum 10, and the temperature in the area where crystallization occurs.

The take-up reel is driven by a variable speed motor 36 which is mechanically linked to a drive gear 38 which drives a drive wheel 40 connected to the take-up reel 20. Since it is desired to match the linear velocity of the starting strip 22 and the ribbon 12 in the contact zone 28, the rotational velocities of the rotating drum 10 and the take-up reel 20 must be converted to linear velocity. The linear velocity of the take-up reel will vary somewhat due to the change in diameter as more starting strip is pre-wound on to the take-up reel 20, or in the case where it is desired to feed an additional leading edge 19 of a ribbon 12 on to a take-up reel which already contains an amount of ribbon cast ribbon material 12, the additional change in the diameter of the take-up reel 20 must be taken into account in determining the linear velocity of the starting strip 22 as it relates to the angular velocity of the take-up reel 20. Thus, a radius sensor 44 is provided with a sensor arm 45 in contact with the surface of the take-up reel 22, which has some starting strip 22 and/or ribbon 12 already wound thereon. A change in the angle of the sensor arm 45 with respect to the radius sensor 44, as is well known in such measuring devices in the art, is a measure of the radius of the take-up reel 20 plus the material wound on the take-up reel 20. An output signal 46 representative of this radius is provided to a controller 42. The velocity of the drive gear 38 connected to variable speed motor 36 is also sensed and an output signal 48 representative of this velocity, and therefore the angular velocity of the take-up reel 20, is also supplied to a controller 42. Similarly, a signal 50 representative of the velocity of the drive gear 32, connected to variable speed motor 30, and representative also of the angular velocity of the rotating drum 10, is supplied to controller 42. Controller 42 compares the linear velocity of the ribbon 12 leaving the surface of the rotating drum 10, which is a function of the radius of the rotating drum and the angular velocity of the rotating drum, with the linear velocity of the starting strip 22 being drawn onto the take-up reel 20, which is a function of the radius of the take-up reel 20 (including the change in the radius due to any material wrapped on the take-up reel 20) and the angular velocity of the take-up reel 20.

Any of a number analog or digital comparators may be included within the speed control controller of 42 to compare the linear velocity of the ribbon 12 with that of the starting strip 22 and generate a control signal 52, as necessary, to speed up or slow down variable speed motor 36 in order to sufficiently match the linear speed of the ribbon 12 and the starting strip 22 in the contact zone 28. By doing so the ribbon 12 will be carried on to the take-up reel 20 by the starting strip 22, without bunching of the ribbon 12 or significant stretching of the ribbon 12. The starting strip conveniently is of a material, e.g., aluminum foil, which will sufficiently frictionally engage the under surface of the cast ribbon 12, when the relative velocity between the ribbon 12 and the starting strip 22 is sufficiently small, to thereby guide the leading edge 19 of the ribbon 12 onto the take-up reel 20 without bunching or significant stretching of the ribbon 12.

It may also be desirable after a sufficient number of rotations of the take-up reel 20 with the ribbon 12 and the starting strip 22 wound about the take-up reel 20 in contact with each other, thereby insuring that the ribbon 12 will be frictionally engaged and not slip from the take-up reel 20 with further rotation of the take-up reel 20, to cut the starting strip 22, leaving only the ribbon 12 itself being wound about the take-up reel 20.

SUMMARY OF THE ADVANTAGES AND SCOPE OF THE INVENTION

It will be appreciated that in a method and apparatus for taking up a cast ribbon of material, e.g., a metal or a semiconductor material according to the present invention, certain significant advantages are provided.

In particular, the take-up reel provides a means for storing a large quantity of cast ribbon produced by a high speed casting process in a convenient manner. The feed system according to the present invention provides a simple and efficient method and apparatus for guiding the leading edge of the cast ribbon onto the take-up reel without damage to the ribbon and without the possibility of cracking the ribbon, thereby necessitating further efforts to feed the ribbon onto the take-up reel. This is particularly advantageous when the cast ribbon is of such a thin dimension, and/or is of an especially brittle material, e.g., crystalline semiconductor material, that the ribbon is easily susceptible to damage, e.g., cracking or breaking. The starting strip and its supply roll will tend to absorb much of the tensile stress in the feeding operation thereby relieving the tensile stress on the ribbon, reducing the likelihood of cracking or breaking the ribbon during the feeding process.

The foregoing description of the invention has been directed to a particular preferred embodiment in accordance with the requirements of the Patent Statutes and for the purpose of explanation and illustration. It will be apparent, however, to those of ordinary skill in this art that many modifications and changes in both the apparatus and method of the present invention may be made without departing from the scope and spirit of the invention. For example, the particular apparatus and means for synchronizing the linear velocity of the ribbon and the starting strip in the contact zone noted above, is illustrative only, and many other methods well known in the art could be useful in achieving the desired result according to the present invention of reducing the relative velocity between the ribbon and the starting strip in the contact zone to an insignificantly small value.

It will further be apparent that the invention may be utilized with suitable modifications within the state of the art, including, e.g., the use of various materials for the starting strip. Examples of some materials which may be useful are aluminum foil, or other thin metal foil, cloth tape, plastic tape, or combinations of these.

These and other modifications of the invention will be apparent to those skilled in the art. It is the Applicant's intention in the following claims to cover all such equivalent modifications and variations as fall within the true spirit and scope of the invention.

What is claimed is:

1. In a method for manufacturing a thin ribbon of material by depositing a ribbon of molten material onto the surface of a rotating drum to allow crystallization of the molten material into a ribbon of cast material to occur, which cast ribbon is to be stored on a take-up reel, an improvement in the method, comprising:

pre-winding of a starting strip onto the take-up reel, which starting strip passes through a contact zone prior to being wrapped around the take-up reel, said contact zone being a zone for contact between the strip and the cast ribbon;

passing the leading edge of the cast ribbon over the starting strip in the contact zone at a speed sufficiently close to that of the starting strip in the contact zone to allow the cast ribbon to be frictionally engaged with, and guided onto the take-up reel by, the starting strip and to pass onto the take-up reel in contact with the starting strip without bunching of the cast ribbon or significant stretching of the cast ribbon.

2. In a method for manufacturing a thin ribbon of material by depositing a ribbon of molten material onto the surface of a rotating drum to allow crystallization of the molten material into a ribbon of cast material to occur, which cast ribbon is to be stored on a take-up reel, an improvement in the method, comprising:

pre-winding of a starting strip of aluminum foil onto the take-up reel, which starting strip passes through a contact zone prior to being wrapped around the take-up reel, said contact zone being a zone for contact between the strip and cast ribbon and said strip having a contact surface sufficiently rough to frictionally engage the surface of the cast ribbon which comes in contact with the starting strip in the contact zone;

passing the leading edge of the cast ribbon over the starting strip in the contact zone at a speed sufficiently close to that of the starting strip in the contact zone to allow the cast ribbon to be guided onto the take-up reel by the starting strip and to pass onto the take-up reel in contact with the starting strip without bunching of the cast ribbon or significant stretching of the cast ribbon.

3. In a method for manufacturing a thin ribbon of material by depositing a ribbon of molten material onto the surface of a rotating drum to allow crystallization of the molten material into a ribbon of cast material to occur, which cast ribbon is to be stored on a take-up reel, an improvement in the method, comprising:

pre-winding of a starting strip onto the take-up reel, which starting strip passes through a contact zone prior to being wrapped around the take-up reel, said contact zone being a zone for contact between the strip and cast ribbon;

passing the leading edge of the cast ribbon over the starting strip in the contact zone at a speed sufficiently close to that of the starting strip in the contact zone to allow the cast ribbon to be guided onto the take-up reel by the starting strip and to pass onto the take-up reel in contact with the starting strip without bunching of the cast ribbon or significant stretching of the cast ribbon;

severing the starting strip once the cast ribbon and starting strip have been wrapped around the take-up reel sufficiently to insure frictional engagement of the cast ribbon.

4. In a method for manufacturing a thin ribbon of material by depositing a ribbon of molten material onto the surface of a rotating drum to allow crystallization of the molten material into a ribbon of cast material to occur, which cast ribbon is to be stored on a take-up reel, an improvement in the method, comprising:

pre-winding of a starting strip for the cast ribbon, without the ribbon, onto the take-up reel, which starting strip passes through a contact zone prior to being wrapped around the take-up reel, said contact zone being a zone for contact between the strip and cast ribbon;

passing the leading edge of the cast ribbon over the starting strip in the contact zone at a speed sufficiently close to that of the starting strip in the contact zone to allow the cast ribbon to be frictionally engaged with, and guided onto the take-up reel by, the starting strip and to pass onto the take-up reel in contact with the starting strip without bunching of the cast ribbon or significant stretching of the cast ribbon.

5. The method of claim 1 wherein, once the cast ribbon and starting strip have been wrapped around the take-up reel sufficiently to insure frictional engagement of the cast ribbon, the starting strip is severed.

6. The method of claim 1 wherein the starting strip has a contact surface of a material having a surface sufficiently rough to frictionally engage the surface of the cast ribbon which comes in contact with the starting strip in the contact zone.

7. The method of claim 6 wherein the starting strip comprises a strip of aluminum foil.

8. The method of claim 1 wherein the angular velocity of the rotating drum and the take-up reel are synchronized so as to have the linear velocity of the cast ribbon and the starting strip be substantially equal in the contact zone.

9. The method of claim 1 wherein the improvement in the method comprises the additional steps of:

winding the starting strip, with the ribbon, around the take-up reel;

continuing the winding of the ribbon around the take-up reel, without the starting strip.

10. The method of claim 1 wherein the starting strip is a strip of metallic material.

11. The method of claim 1 wherein the starting strip is a strip of metallic foil.

* * * * *